United States Patent [19]

Fujita

[11] 4,427,863

[45] Jan. 24, 1984

[54] SMALL-SIZED RELAY AND METHOD FOR FABRICATING THE SAME

[75] Inventor: Teizo Fujita, Ibaraki, Japan

[73] Assignee: Izumi Denki Corporation, Osaka, Japan

[21] Appl. No.: 360,869

[22] Filed: Mar. 22, 1982

[51] Int. Cl.[3] ..... H01H 9/04

[52] U.S. Cl. ..... 200/306

[58] Field of Search ..... 200/306, 302; 220/371, 220/372; 229/DIG. 14; 29/622; 174/17 VA; 219/121 LK, 121 LL

[56] References Cited

U.S. PATENT DOCUMENTS

| | | | |
|---|---|---|---|
| 2,284,644 | 6/1942 | Dubilier | 200/306 X |
| 3,043,939 | 7/1962 | Gryetko et al. | 200/306 X |
| 3,336,457 | 8/1967 | Julian et al. | 200/306 |
| 3,617,683 | 11/1971 | Beresford et al. | 219/121 LK |
| 3,694,566 | 9/1972 | Thompson et al. | 220/372 X |
| 4,063,383 | 12/1977 | Green | 206/439 X |

FOREIGN PATENT DOCUMENTS

| | | | |
|---|---|---|---|
| 53-74039 | 6/1978 | Japan | 200/306 |

*Primary Examiner*—John W. Shepperd
*Assistant Examiner*—Renee S. Kidorf
*Attorney, Agent, or Firm*—Pollock, Vande Sande & Priddy

[57] ABSTRACT

A small-sized relay and a method for fabricating the same are disclosed. The relay comprises a prefabricated relay mechanism and an insulating cover covering the relay mechanism. Prior to assembling the relay mechanism and cover, a laser machining device is utilized to form, in the cover, holes of very small diameter which permit flow of gas molecules therethrough but do not permit the flow of dust particles or liquid molecules therethrough. The prefabricated relay mechanism is covered with the cover formed with such holes, and the opening of the cover except the portion including the holes is closed to hermetically seal the relay mechanism.

2 Claims, 2 Drawing Figures

SMALL-SIZED RELAY AND METHOD FOR FABRICATING THE SAME

BACKGROUND OF THE INVENTION

1. Field of the Invention

This invention relates to small-sized relays. More particularly, this invention relates to an improved small-sized relay hermetically sealed or enclosed which is provided in its cover portion with a plurality of holes of very small diameter permitting a flow of gas molecules therethrough but not permitting the flow of dust particles and liquid molecules therethrough, and relates also to a method for fabricating such a relay.

2. Description of the Prior Art

In a small-sized relay, it has been typical to enclose its relay mechanism by an enclosure or cover for preventing intrusion or permeation of dust and moisture from the exterior, as disclosed in, for example, copending United States patent application Ser. No. 298,433 filed by the same inventor on Sept. 1, 1981. The object of the copending patent application is to isolate the internal relay mechanism from the ambient atmosphere thereby protecting the parts including the relay contacts from being affected by various external conditions encountered by the relay in the environment in which the relay is used.

However, in such a small-sized relay of the enclosed type, an increase in the frequency of operation of the relay contacts has sometimes resulted in the tendency of rusting of the parts including the contacts and yoke in the relay mechanism, and the formation of rust has provided a principal source of degradation of the relay or misfunction of the relay contacts.

In an attempt to obviate such a defect, a proposal has been made in which a vent hole is formed in the cover portion of the relay, as will be described later with reference to FIG. 1. However, a small-sized relay of the type considered herein is frequently mounted on a printed circuit board. In such a case, soldering is commonly employed for establishing predetermined electrical connections between the relay and the printed circuit board after the relay is mounted in a predetermined position on the printed circuit board, and it is necessary to wash away the soldering flux after the step of soldering. In this washing step, washing with the washing solution has been applied to the soldered area only of the relay provided with such a vent hole in the cover so that the washing solution may not flow into the relay through the vent hole formed in the cover. Therefore, the above proposal has still been defective in that a limited portion only of the relay can be washed. One of the attempts for obviating such a defect is disclosed in Japanese Patent Publication No. 1852/1982 published Jan. 13, 1982. According to the disclosure of this patent publication, a portion of the cover of a relay of the enclosed type is removed to form a venting structure in the cover after the relay has been mounted on a printed circuit board by soldering and then washed with a washing solution. The above-described method is therefore advantageous in that there is no possibility of flowing of the washing solution into the relay although the relay is bodily immersed in the washing solution for washing of the whole including its soldered area.

However, the method disclosed in Japanese Patent Publication No. 1852/1982 cited above has still been defective in that, because of the necessity for formation of a venting structure in the cover of each individual relay after the steps of mounting it on a printed circuit board and washing it with a washing solution, considerable man-hours are required for the fabrication.

SUMMARY OF THE INVENTION

It is a primary object of the present invention to obviate all of the prior art defects pointed out above and to provide an improved small-sized relay of the enclosed type which is formed in its cover portion with a plurality of holes of very small diameter permitting flow of gaseous state molecules therethrough but not permitting flow of dust, solid state particles and liquid state molecules therethrough.

The present invention will now be described with reference to the accompanying drawings.

DESCRIPTION OF THE INVENTION

Figure 1:
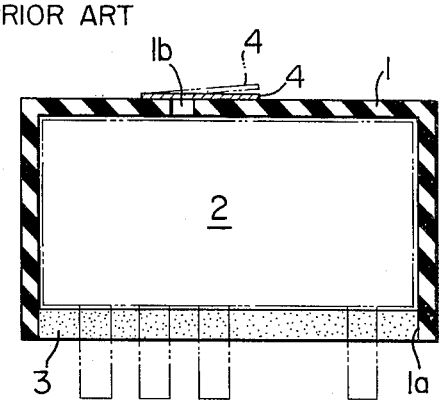
FIG. 1 PRIOR ART
FIG. 1 is a sectional view of a prior art small-sized relay having a venting structure.

For better understanding of the present invention, a prior art small-sized relay shown in FIG. 1 will be described before describing a preferred embodiment of the present invention in detail. The prior art small-sized relay shown in FIG. 1 is constructed by enclosing a relay mechanism 2 within a cover 1 and, then, hermetically sealing the opening 1*a* of the cover 1 by a molded member 3 of a material such as a synthetic resin.

The enclosed relay of this kind has been developed for the primary purpose of protecting the parts including the contacts from various external conditions encountered by the relay in the installed environment of the relay, by isolating the relay mechanism 2 from the ambient atmosphere. However, in such a small-sized relay of the enclosed type, an increase in frequency of the on-off operation of the relay contacts has sometimes resulted in the tendency of rusting of the parts including the contacts and yoke in the relay mechanism 2, and the formation of rust has provided a principal source of degradation of the relay or malfunction of the relay contacts.

In an effort to solve the above problem, means such as a vent hole 1*b* has been directly formed in the cover 1 of the enclosed relay or a valve 4 has been disposed on the vent hole 1*b* to be normally maintained in the closed position closing the vent hole 1*b* but biased to its open position in response to build-up of the internal pressure of the relay to permit communication of the interior of the relay to the exterior through the vent hole 1*b*, so that a gas produced in the relay can be discharged to the exterior through the vent hole 1*b* thereby eliminating the source of degradation of the relay or malfunction of the relay contacts. However, the relay provided with such means has still been defective in that, when the relay is operated in an atmosphere of high humidity over a long period of time, moisture drawn into the relay through the vent hole 1*b* will change the operating characteristic of the relay or form rust on the relay parts resulting in a shortened useful service life of the relay. Further, the relay provided with the vent hole 1*b* alone has been defective in that the efficiency of fabrication is very low since, as described hereinbefore, washing with a washing solution for the removal of the soldering flux is applicable only to the soldered area of the relay mounted on and electrically connected to a printed circuit board by soldering. Furthermore, the relay provided with the valve 4 normally maintained in the closed position closing the vent hole 1*b* has also been defective in that an additional step for mounting the valve 4 on the cover 1 is required resulting in an increased cost. The method disclosed in Japanese Patent Publication No. 1852/1982 cited hereinbefore has had a defect as pointed out already.

Figure 2:
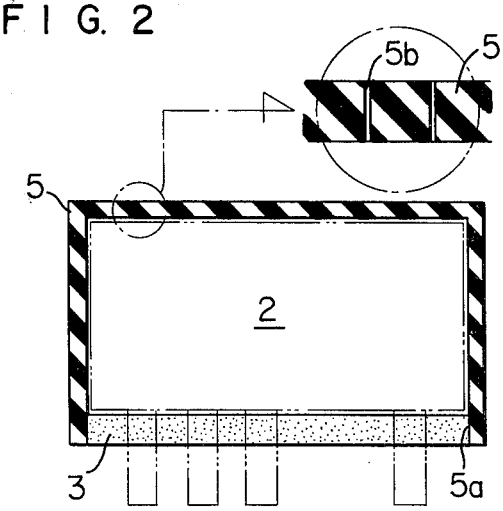
FIG. 2 is a sectional view of a preferred embodiment of the smalled-sized relay having a venting structure according to the present invention.

FIG. 2 shows a preferred embodiment of the small-sized relay according to the present invention. The relay according to the present invention is featured by the fact that a laser machining device presently widely used is employed for boring holes of very small diameter in a relay cover 5 made of an electrical insulator such as a synthetic resin or ceramic material. More precisely, a commercially available laser machining device, for example $CO_2$ laser machining device, is employed to bore a plurality of holes 5*b* of very small diameter in the relay cover 5 as shown in FIG. 2. These holes 5*b* are so sized as to permit flow of gaseous state molecules therethrough but not permit flow of dust particles and liquid state molecules therethrough. The cover 5 provided with such holes 5*b* covers a prefabricated relay mechanism 2, and the opening 5*a* of this cover 5 is closed or hermetically sealed by a molded member 3 of a synthetic resin.

The laser machining device of the kind described above has the merit that it can very accurately bore a hole of very small diameter in a workpiece the material of which may be a metal, plastics, ceramics, glass or rubber.

According to the relay of the present invention which utilizes the relay cover machined in the manner described above, a gas produced in the relay due to frequent on-off operations of the contacts in the relay mechanism 2 is discharged to the exterior through the plural holes 5*b* of very small diameter formed in the cover 5. On the other hand, these holes 5*b* of very small diameter do not permit flow of not only dust particles but also liquid state molecules therethrough even when the relay is placed or operated in an atmosphere of high humidity over a long period of time. Therefore, because there is no possibility of introducing moisture into the relay, no change occurs in the operating characteristic of the relay, and shortening of the useful service life of the relay due to formation of rust is prevented.

In addition, the present invention has a great advantage that the relay can be bodily immersed together with the printed circuit board in a washing solution to be bodily washed, in contrast to the prior art practice in which washing with the washing solution for the removal of the soldering flux is applicable only to the soldered area of the relay mounted on and electrically connected to the printed circuit board by soldering. Therefore, the efficiency of fabrication can be improved, and the fabricating process can be automated.

I claim:

1. A method for fabricating a small-sized relay comprising the steps of:

prefabricating a relay mechanism;

forming a plurality of holes of very small diameter by a laser machining device in a previously prepared impermeable cover of an electrical insulator with an open side, said holes having a size which permits the flow of gaseous state molecules therethrough and stops the flow of dust particles and liquid state molecules therethrough;

subsequently assembling said cover with said relay mechanism to cover said relay mechanism; and closing only the opening of said cover to form a hermetic seal with said relay mechanism except for the portion including said previously formed holes of very small diameter.

2. A small-sized relay comprising:

a relay mechanism;

a cover of an electrical insulator having an opening and covering said relay mechanism;

a plurality of holes of very small diameter formed in said cover, said holes being sized to permit flow of gaseous state molecules therethrough and to stop the flow of dust particles and liquid state molecules therethrough, said holes being provided at a major surface of said cover; and means for subsequently hermetically sealing only the opening of said cover with said relay mechanism except for the portion including said previously formed holes of very small diameter, whereby said impermeable cover is provided with previously formed uniform holes permeable to gaseous state molecules and impermeable to liquid and solid state molecules.

* * * * *